US005533758A

United States Patent [19]

Lee

[11] Patent Number: 5,533,758

[45] Date of Patent: Jul. 9, 1996

[54] BOOK COVER CORNER GUARD

[76] Inventor: Kenneth R. Lee, 2332 Sable Tree Cir., Tustin, Calif. 92680

[21] Appl. No.: 423,773

[22] Filed: Apr. 18, 1995

[51] Int. Cl.[6] ..... B42D 1/00

[52] U.S. Cl. ..... 281/20

[58] Field of Search ..... 281/18, 20, 15.1, 281/38, 51

[56] References Cited

U.S. PATENT DOCUMENTS

| | | | |
|---|---|---|---|
| 295,141 | 3/1884 | Akins . | |
| 308,718 | 12/1884 | Weaver . | |
| 318,486 | 5/1885 | Martin . | |
| 536,315 | 3/1895 | Wright . | |
| 768,313 | 8/1904 | Scherf | 281/20 |
| 964,895 | 7/1910 | Bernhardt | 281/20 |
| 1,676,741 | 7/1928 | Moskowitz | 281/20 |
| 1,773,742 | 8/1930 | Milton . | |
| 2,728,451 | 12/1955 | Leander | 206/60 |

FOREIGN PATENT DOCUMENTS

| | | | |
|---|---|---|---|
| 2688170 | 9/1993 | France | 281/20 |

*Primary Examiner*—Willmon Fridie, Jr.

*Attorney, Agent, or Firm*—Gene Scott

[57] ABSTRACT

An improved corner guard that consists of a guard body with an adhesive bottom surface layer, a pair of orthogonal fold lines designed to align with a pair of corner edges, a pair of fold-over tabs extending outwardly from the fold lines, the tabs designed to fold over the corner edges and adhere to a back surface of the corner. A folding enhancement means, such as a perforated or pre-scored line is positioned along the length of the tabs on the fold lines so that the tabs can be quickly and properly folded. A pair of fixed edge tab portions extend inwardly from the fold lines, and preferably include at least one curvilinear portion, and a central portion extends inwardly from the fixed edge tab portions. The central portion extends away from the corner, and may additionally include one or more curvilinear portions to prevent objects from catching or tearing on the corner guard. Additionally, the entire perimeter of the corner guard has a beveled edge to further allow objects to slide easily over the guard without catching or tearing. The fold-over tabs may be torn off after alignment of the guard with the corner of the book. The fold-over tabs may be positioned permanently at right angles to the body for alignment of the guard with the book, and may include means for biasing the book cover in a flat and closed position.

17 Claims, 4 Drawing Sheets

BOOK COVER CORNER GUARD

BACKGROUND OF THE INVENTION

1. Field of the Invention

This invention relates generally to protective corner guards for pages or book covers, especially thin flexible book covers such as is used on paperback books, and more particularly to an improved corner guard configured to allow opposing pages or book covers to slide easily over the guard without catching on its edges, while also helping the protected corner from becoming creased, torn or weakened.

2. Description of the Related Art

Many documents, both bound and unbound, include a cover constructed from paper, cardboard, leather or the like that is designed to protect the enclosed sheets of the document. Unfortunately, covers are themselves susceptible to gradual wear and progressive damage, and once a cover becomes significantly damaged, the enclosed pages are left with less protection and more subject to damage. Invention and use of complete document covers are well known to the public, as there is a wide variety of different paper, plastic and cloth covers available to protect the entire cover and protect an entire document cover. However, these cover protectors are generally, bulky, inconvenient, and difficult to properly position over a book cover. In addition, they generally obscure a book cover and its design.

The corners of a document are typically the most susceptible to being bent or torn, which is particularly undesirable since corner damage makes it difficult to easily and quickly turn the pages. Thus, invention and use of protection devices designed expressly to protect page and book corners is well known to the public. Corner protectors are much more light weight and non-obtrusive than full page covers designed to cover the entire document cover.

Prior art corner protectors have typically been constructed with one of two different basic configurations. The most common configuration consist essentially of a triangular strip of heavy duty paper, cardboard or metal that fits across the outer surface of a corner providing an edge that is at approximately a 45° angle to the edges of the page or book cover.

For example, Leander U.S. Pat. No. 2,728,451 discloses a corner protector that is the shape of a right triangle. A perforation is positioned along the height of the triangle, thereby effectively dividing the protector into two smaller right triangles. To position the protector over the corner, one of the two smaller triangles is placed over the front side of a corner so that the right angle of the protector is aligned with the right angle of the corner and the perforation is aligned with one of the edges of the paper. The protector is then simply folded along the perforation so that the other of the two triangles covers the back side of the corner in the same manner.

Moskowitz U.S. Pat. No. 1,676,741 discloses a corner protector that is formed of two pieces of triangular metal. The two pieces are of identical size and shape and are designed to be engaged with a beaded clamping means. Thus, to protect a corner, one piece of metal is aligned with the back of the corner and the other piece is aligned with the front of the corner and the two pieces are then clamped together.

Wright et al. U.S. Pat. No. 536,315, Akins U.S. Pat. No. 295,141 and Martin U.S. Pat. No. 318,486 all disclose similar corner protecting means in which the protector covers the front side of the corner at a 45° angle. These protectors differ only in their specific methods of folding and application.

While corner covers with this 45° structure may effectively protect the underlying portion of the corner from excessive damage, the protectors themselves often damage the corner. Damage occurs because, with the corner guard in place, the reinforced corner does not tend to bend and flex naturally, but instead always creases sharply along the edge of the guard. Thus, a large, permanent crease gradually forms in the corner along the edge of the guard, which, over time, may actually cause the protected corner to be severed from the rest of the cover.

The other major corner protector configuration is essentially L-shaped, with an elongate strip of material aligned with each of the edges of the corner. This type of protector is illustrated in both Milton U.S. Pat. No. 1,773,742 and Weaver U.S. Pat. No. 308,718. This configuration improves over the previously described protectors in that it does not create a straight edge across the corner that is easily bent. However, this configuration also has significant drawbacks. First of all, the L-shape protector covers and protects only the outermost edges of the corners, and thus leaves a much larger surface area uncovered than the prior art employing the 45° design. In addition, the exposed portion of the corner along the edge of the L-shaped protectors is generally very weak and susceptible to puncture.

Even further, all of these prior art devices provide sharp, pointed edges and corners, and are thus prone to easily catching on items such as a page or cover of a book, or a fingernail, etc.. This is obviously undesirable, and may result not only in scraping or scratching the particular item, but also in tearing or premature wearing of the corner guard itself.

Thus there is a significant need for an improved corner protector that can overcome all of the disadvantages of the prior art. Such a corner would not cut straight across the corner, nor would it conform in shape to the contour of the corner.

The present invention fulfills these needs and provides further related advantages as described in the following summary.

SUMMARY OF THE INVENTION

The present invention is an improved corner guard designed to more comprehensively protect the corners of a book from excessive wear or damage. The corner guard is especially suited for protecting the corner of a book cover, but it may also be used to protect the corner of a wide variety of different objects, such as poster board or sheet metal, as long as the corner to be protected is relatively flat and is formed having two perpendicular edges. The corner guard improves significantly over prior art corner protecting means in that it protects the corner not merely from long-term wear and damage but also from corner bending, creasing or puncturing.

The guard of the present invention preferably is made of a heavy paper stock of reinforced, laminated or impregnated material or a rigid plastic sheet material and is cut, in the flat, into a useful shape consisting of a guard body with a bottom surface in contact with and adhered to a book cover, and a top surface facing away from the book cover. Thus, it is a primary object of the invention to rigidize the book corner so that it cannot be easily creased, torn or otherwise damaged.

Two orthogonal fold lines define edges of the corner guard when it is folded around a book corner, the fold lines being preferably aligned with the two edges which form the corner of the book cover. In one of the preferred embodiments a fold-over tab, contiguous with the body, extends outwardly from each of the edges of the book cover. These tabs are designed to be folded over the edges of the book corner and adhered to a back surface of the book cover. A means for folding enhancement, such as a perforation or pre-score, is formed on the fold line along the length of each tab. The folding enhancement means ensures that the tabs are evenly folded forming a smooth edge along the edge of the book cover. Additionally, a dashed line is preferably imprinted on the body's top surface over the means for folding enhancement, thus providing a visual aid by which to properly fold the tabs. To even further assist in the folding process, the tabs may additionally include one or more curvilinear portions by which to grasp and manipulate the tabs. These curved portions are also effective in preventing inside pages of the book from catching or tearing on the tabs when they are secured against the back of the cover. The tabs are configured so that when both are secured in the folded over position, they abut forming a common edge. Thus, it is an object of the present invention to provide a corner guard that is extremely easy to properly apply to a book corner and which has portions which when folded over the edges of the book corner perfect the implementation of the invention.

In alternate preferred embodiments of the present invention, the fold-over tabs may be torn off once the guard is accurately aligned with the cover corner, or they may be pre-folded at a right angle to the guard so that with the guard positioned in contact with the corner of the cover page, the tabs extend downwardly along the edges of the book pages.

That portion of the body immediately adjacent to the book cover's edges are configured as a pair of fixed edge tab portions. These fixed edge tab portions extend along the edges of the corner, thus protecting the top surface of the corner along both of the edges of the corner. The fixed edge tab portions may have a length that is greater than, equal to, or less then that of the fold-over tabs. Thereby, an object of the present invention is to provide a book cover corner protector that includes a pair of fold-over tabs for sandwiching the edges of a book corner between folded-over and fixed edge tabs, thereby reinforcing the book corner on both of its opposing surfaces.

A key inventive feature of the present invention is the configuration of the central portion of the corner guard that extends between the fixed edge tab portions. The central portion provides a peripheral edge which may take several advantageous configurations. As for example this edge may have two orthogonal portions meeting at an apex, or it may be radiused either outwardly away from the corner, or inwardly toward the corner. Thus, it is an object of the present invention to provide a corner guard that covers substantially more area of the corner than prior L-shaped corners, while also covering the corner in such a way that it does not tend to bend or crease along the edge of the guard, as is common with prior art devices that cut across the corner at a 45° angle.

However, the present invention not only provides a design that improves over prior art devices, but it also includes several features that help reduce shelf abrasion, catching and edge fraying of the guard which frequently results from repeated or extended contact with other books, fingers or objects. For example, the edge of the body portion is formed of smooth curves so as not to present a sharp corner to catch on passing paper edges. Additionally, wherever a straight linear edge is provided, such edge is preferably broken by a curved portion. Even further, the perimeter of the entire corner guard preferably has a beveled edge. These features all prevent abutting book pages, book covers and other such objects from catching on the guard, and instead enables objects to easily slide over it. Thus it is an object of the present invention not only to provide a design that improves over prior art devices but also improves the stability and wearability of the corner guard.

In the preferred embodiment of the invention wherein the two fold-over tabs are constructed so as to be permanently positioned at right angles to the body of the invention, these tabs may additionally have a inwardly extending linear ridge positioned for contact with the pages of the book so as to catch on these pages and therefore hold the cover flat against the book. Thus it is one object of the invention to provide a corner guard for a book which also holds the covers of a paperback book in a flat and closed position.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the instant invention, a book cover corner guard. In such drawings.

DETAILED DESCRIPTION OF THE PREFERRED EMBODIMENT

Figure 1:
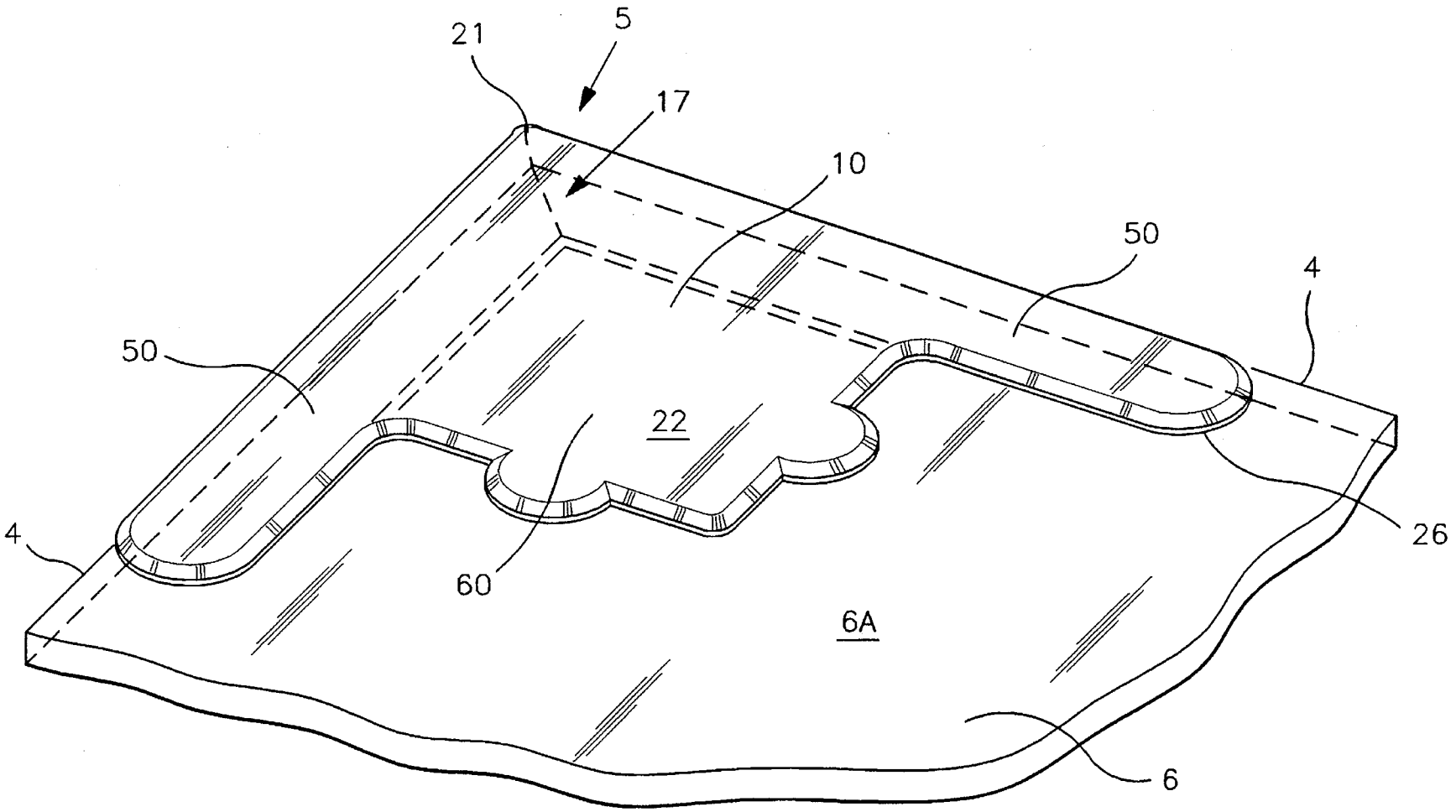
FIG. 1 is a perspective view of a preferred embodiment of the corner guard, particularly showing the corner guard as positioned over a book corner and fold-over tabs in contact with the rear side of the book corner.

FIGS. 1–10 show several preferred embodiments of the present inventive corner guard designed to protect a corner 5 of a book cover 6 or other sheet product having a corner from excessive wear or damage, provided the corner to be covered is relatively flat and is composed of two perpendicular edges 4. The corner guard can be constructed of a variety of different reinforced flat sheet materials, such as plastic, cardboard, coated paper, sheet metal or stiff leather. The type of material the corner guard is constructed of depends on properties necessary for the intended use of the guard, i.e., strength, flexibility, tear resistance, and so on. In the following description the guard will be described as applied to the corner 5 of a book cover 6, although it is by no means limited to such application.

The sheet material is cut, in the flat, so that the corner guard preferably includes a guard body 10, comprised of a pair of fixed edge tab portions 50 and a central body portion 60, and a pair of fold-over tabs 40. The guard body has a top surface 22 and a bottom surface 24. The top surface 22 is designed to face away from the book cover 6 and may be laminated or otherwise reinforced. Additionally, the top surface 22 may include printed indicia, graphics, instructions for proper application of the corner guard, etc. The guard body's bottom surface 24, on the other hand, is designed to contact and permanently attach to an upfacing surface 6A of the book cover's corner 5. Thus, the bottom surface 24 is coated with an adhesive layer 26, preferably a hot melt rubber adhesive such as emulsion acrylic adhesive. Either an active or a non-active adhesive layer 26 can be successfully implemented within the scope of the present invention. When an active adhesive layer 26 is implemented, a sheet of non-stick material 28 covers the adhesive layer 26 so that the sheet 28 can be simply peeled from the guard body 10, thus exposing the active adhesive layer 26 when it is desired to adhere the guard to a book cover 6. Alternately, a non-active adhesive layer 26 may be implemented, preferably of the type activated by contact with water or alcohol, etc.

Figure 2:
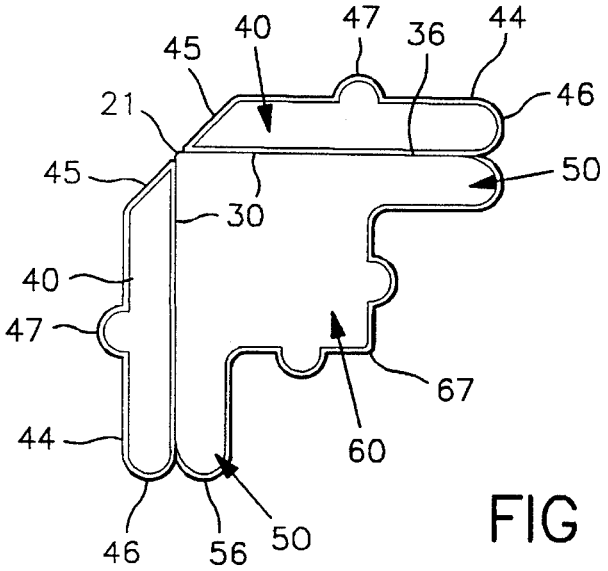
FIG. 2 is a top plan view of one embodiment of the guard of FIG. 1 but shown in the flat, particularly showing a pair of fold-over tabs with a length approximately equal to that of a pair of fixed edge tab portions, and a beveled edge along the exterior edges of the guard.

The guard body 10 also includes a pair of mutually orthogonal fold lines 30 that intersect at a point 21, thus forming a guard corner 17. The orthogonal fold lines 30 are designed to align with the edges 4 of the book cover corner 5 so that the guard corner 17 covers the top surface 6A of the corner 5 when the fold lines 30 are properly aligned with the edges 4. Preferably, as illustrated in FIG. 2, the point 21 at which the fold lines 30 intersect is rounded so as to keep the point 21 from catching on items while also giving the guard corner 17 added strength against abrasion.

The fixed edge tab portions 50 of the guard body abut the fold lines 30 and extend inwardly from them. Each of the fixed edge tab portions 50 preferably includes at least one curvilinear portion 56, as illustrated in the figures. The curvilinear portions 56 effectively prevent other book covers, clothing, skin or the like from catching or scratching on the guard, as the curvilinear portions 56 allow items to slip easily and smoothly over the guard's edges. The fixed edge tab portions 50 can be constructed to any desired fixed length, preferably not to exceed more than half the width of the book cover 6.

The central portion 60 of the guard body 10 extends inwardly from the fixed edge tab portions 50. There are numerous possible embodiments of the central portion 60 that can be implemented successfully within the scope of the present invention, several of which are illustrated in the figures. In a first preferred embodiment, illustrated in FIGS. 2 and 3, the central portion 60 forms an apex 67 pointing away from the corner 5 of the book cover 6. The apex 67, which is preferably rounded (FIG. 2), effectively serves as an extended strength point of the guard so that when the corner 5 is slightly bent, as is necessary for turning the book cover 6 by grasping the corner 5, the apex 67 transfers the force downwardly toward the center of the cover 6, thus effectively preventing the corner 5 from being creased or torn.

Figure 6:
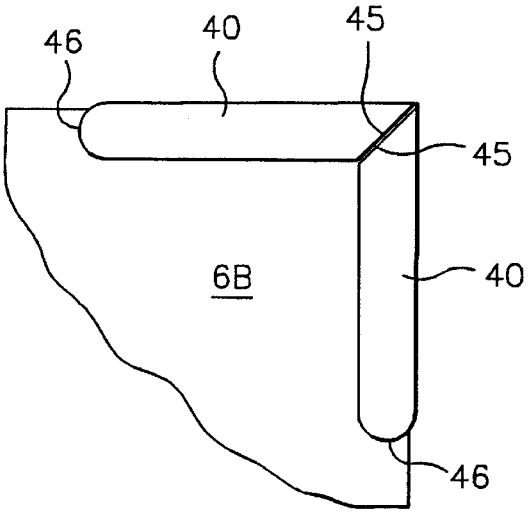
FIG. 6 is an plan view of the reverse side of the book corner demonstrating the positions of the fold-over tabs when positioned thereon.
Figure 7:
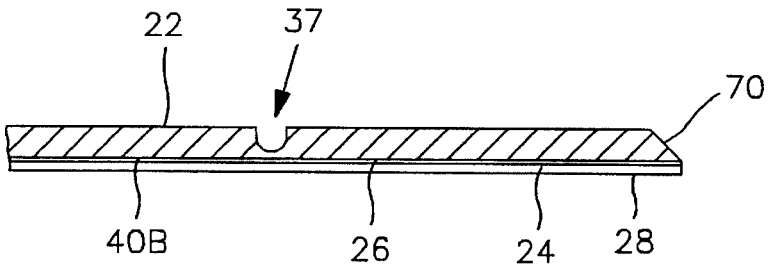
FIG. 7 is a side elevational view of a portion of the corner the guard, particularly showing a means for folding enhancement and the beveled edge of the guard's perimeter.

In this embodiment, the central portion 60 also preferably includes at least one curvilinear portion 66 on each side of the apex 67. These curvilinear portions 66 give the guard improved structural stability while also helping to reduce shelf abrasion, catching and edge fraying of the guard that can result from repeated or extended contact with other books or items when they are shelved or stacked against the book cover 6. Alternately, the central portion 60 is outwardly curved (FIG. 6), or inwardly curved (FIG. 7). It should be noted that in all these embodiments, the point at which the central portion 60 and the fixed edge tab portions 50 intersect is at least slightly radiused, again to prevent catching and allow objects to move smoothly over the guard.

The fold-over tabs 40 are attached to and extend laterally from the fold lines 30, each tab thus being foldable along the fold lines 30 so as to extend over corner edges 4 of the book cover 6. The fold-over tabs 40 each have a delimiting edge 44 that defines the shape of the tabs 40. There are numerous possible embodiments of the fold-over tabs 40 that can be successfully implemented within the scope of the present invention, several of which are illustrated in the figures. In a first preferred embodiment, illustrated in FIGS. 1–5, when the guard corner 17 is properly aligned with the book cover corner 5, the fold-over tabs 40 are easily folded over the cover's corner edges 4 and adhered to a back surface 6B of the book cover 6. In this embodiment, as seen in FIG. 7, a bottom surface 40B of the tab portions 40 include an adhesive layer 26 by which to adhere the tabs 40 to the back surface 60B of the book cover 6. When an active adhesive layer 26 is implemented, a single sheet of non-stick material 28 may cover the bottom surfaces 24 and 40B of both the guard body 10 and the tabs 40, as shown in FIG. 7, or, alternately, a separate sheet 28 of the non-stick material may be placed over each tab 40 and the guard body so that the sheets 28 are removable in an order corresponding with the steps for proper application of the guard.

Figure 4:
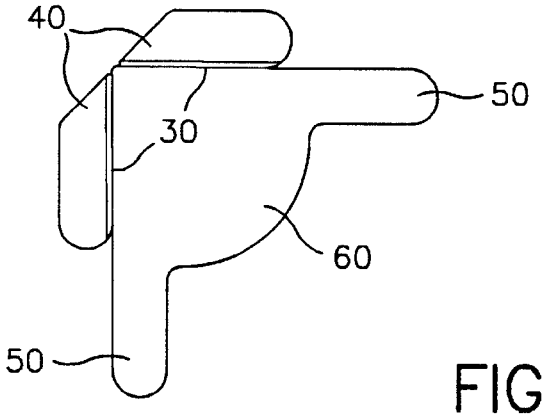
FIG. 4 is view similar to that of FIG. 3, showing a curved, outwardly extending central portion as an alternate embodiment.
Figure 5:
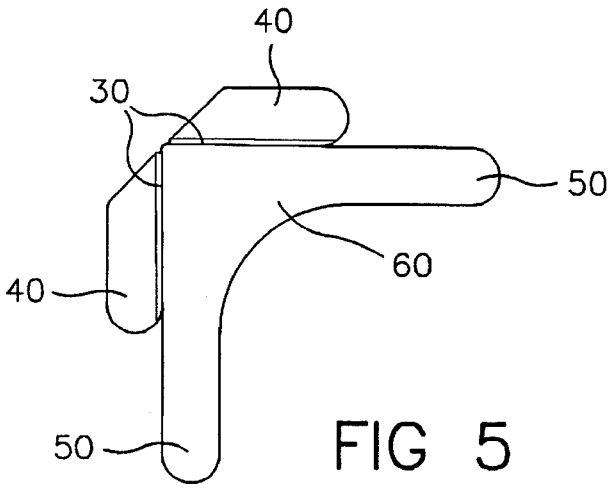
FIG. 5 is view similar to that of FIG. 3, showing a curved, inwardly extending central portion as an alternate embodiment.

In this embodiment, as illustrated in FIGS. 2–5, a portion of each of the delimiting edges 44 is cut so as to form angled portions 45 that are co-linear with one another and terminate at the intersection point 21 of the fold lines 30. When the guard is laid-out in the flat. When the tabs 40 are folded over against the back surface 6B of the cover 6, as illustrated in FIG. 6, the angled portions 45 nearly abut with one another. As also illustrated in FIGS. 2–5, at least one portion of each of the delimiting edges 44 is curvilinear, thus forming curvilinear portions 46. However, as illustrated in FIG. 2, each of the delimiting edges 44 may include additional curvilinear portions 47. All of these curvilinear portions 46 and 47 allow pages of the book to slip easily over the tabs 40 instead of catching or tearing on them, while also aiding a user in properly folding the tabs 40 against the back surface 6B of the corner 5.

Figure 8:
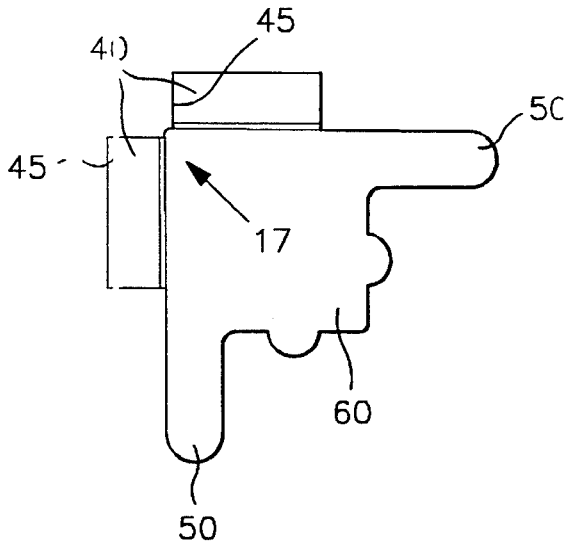
FIG. 8 is a plan view of one embodiment of the guard of FIG. 1, particularly showing a pair of fold-over tabs designed to be folded at right angles to the guard body for accurate positioning of the guard corner, and then simply torn away.

In another embodiment, illustrated in FIG. 8, the tab portions 40 are designed to aid in quickly and easily aligning the guard corner precisely with the corner 5 of the book cover 6. As illustrated, in this embodiment, rather than having angled portions 45 that are in co-linear alignment, the tabs 40 preferably have a relatively rectangular shape so that when the tabs are folded at right angles to the guard body, the angled portions 45 abut one another, thus allowing the guard corner 17 to be precisely aligned with the cover corner 5 by simply sliding the guard over the corner until the edges 4 of the corner 5 contact the tabs 40. Once the guard body 10 has been properly aligned and adhered to the corner 5, the fold-over tabs 40 can simply be torn along the fold lines 30 and removed.

In these embodiment, a means for fold enablement 37 is formed consonant with the fold lines 30 so as to ensure that the tabs 40 are easily and properly folded along the fold lines 30. Preferably the means for fold enablement 37 is a perforated or pre-scored line (FIG. 7). Such a pre-scored line is produced by indenting the top surface 22 so as to bias the tab 40 to fold along the pre-score, and not elsewhere. The means for fold enablement 37 must have a width approximately equal to the thickness of the of the cover 6 so that the means for enablement 37 conforms to the edges 4 of the corner 5 when the tabs 40 are folded-over. Additionally, a dashed line (not shown) may be imprinted on the guard's top surface 22 over the means for fold enablement 37, thus providing a visual aid by which to properly fold the tabs 40 along the fold lines 30.

Figure 9:
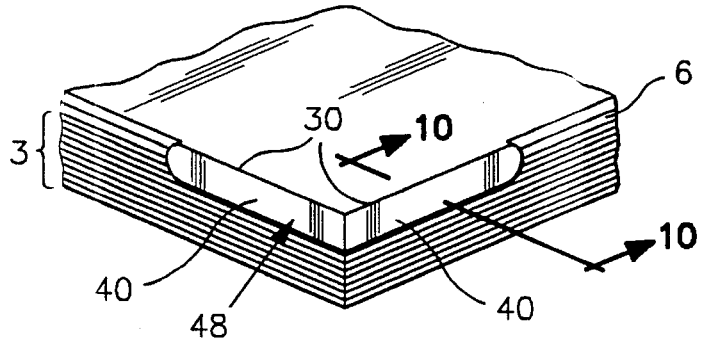
FIG. 9 is a perspective view of another embodiment of the guard of FIG. 1, particularly showing the fold-over tabs fixedly positioned at right angles to the body so as to form a preformed tab corner that rests in overlapping adjacency with the corner of the book.
Figure 10:
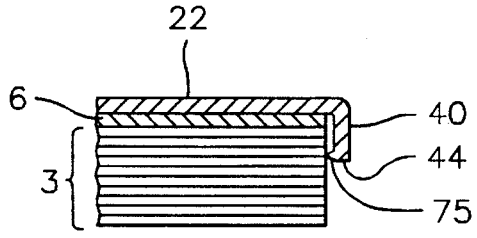
FIG. 10 is a cross sectional view of the invention of FIG. 9 taken along line 10—10, particularly showing a rib extending from the delimiting edge of the prefolded tab portions so as to engage with the pages of the book so as to encourage the shown position of the book cover.

In yet another embodiment, illustrated in FIG. 9, the fold-over tabs 40 may be manufactured so that they are already pre-folded at right angles to the guard body 10. As illustrated, in this embodiment the tabs 40 are shaped so that they abut, and preferably the tabs 40 are secured together so that they cannot move apart from one another, thus forming a sturdy, preformed tab corner 48. Thus, to properly position the corner guard so that the guard corner 17 is precisely aligned with the cover corner 5, the guard is slid over the cover corner 5 until the edges 4 of the cover contact the pre-folded tabs 40. As illustrated in FIG. 10, when the guard body 10 is positioned in contact with the corner of the cover, the tab corner 48 is in overlapping adjacency with the corner of the book pages 3. Preferably, as illustrated in FIG. 10, each of the fold-over tabs includes a rib 75 positioned along the delimiting edge 44. The ribs 75 extend inwardly toward the pages 3 of the book, thus engaging the fold-over tabs 40 with the book pages 3 so that the cover 6 is maintained in a closed position.

Figure 3:
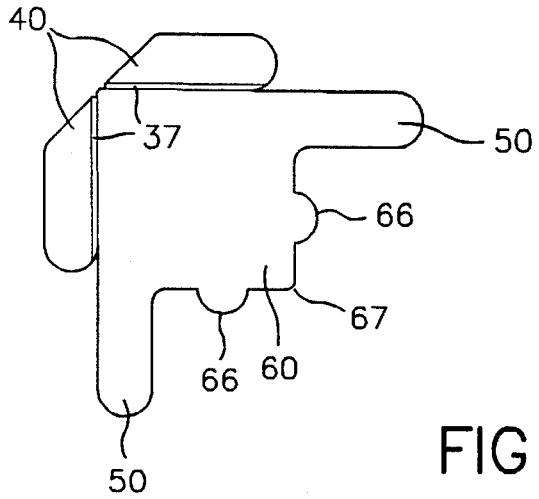
FIG. 3 is a view similar to that of FIG. 2, particularly showing the fold-over tabs with a length less than that of the fixed edge tab portions.

The fold-over tabs 40 can be constructed to any desired fixed length, preferably equal or less than that of the fixed edge tab portions 50. In FIGS. 3–5 the tabs 40 are smaller in area than the edge tab portions 50 whereas in FIG. 2 the fold-over tabs 40 are approximately equal in area to the edge tab portions 50.

To even further ensure that book pages, book covers and other such objects do not catch on the guard but rather slip easily over it, the perimeter of the entire corner guard preferably has a beveled edge 70 which forms a down-sloping perimeter, as illustrated in FIG. 7.

While the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. A book cover corner guard for reinforcing a corner of a book cover of a book, the guard comprising:

a guard body aligned with an outer surface of the book corner, and providing a bottom surface contacting the book cover and a top surface facing outwardly from the book cover; wherein the bottom surface, is coated with an adhesive for adhering the body to the outer surface;

on the guard body, a first and second mutually orthogonal fold lines intersecting to form a guard corner aligned with the book cover corner, the fold lines including a means for fold enablement;

attached contiguously to and extending laterally from the fold lines respectively, a first and a second fold-over tabs, foldable along the fold lines to extend respectively over corner edges of the book cover;

a first and second fixed edge tab portions of the body, the tab portions aligned in mutual orthogonal juxtaposition, each of the tabs abutting one of the fold lines;

a central portion of the guard body contiguous with the two fixed edge tab portions and extending therebetween, the fixed edge tab portions and the central portion, together, adhered to the outer surface of the book cover.

2. The book cover corner guard of claim 1 wherein each of the fold-over tabs is in adhesively fixed contact with the back surface of the book cover and provides a delimiting edge, at least one portion of the delimiting edge being curvilinear in such a manner as to urge abutting book pages to slip easily over the fold-over tab.

3. The book cover corner guard of claim 2 wherein each of the first fold-over tabs further comprises a linear angled portion of the delimiting edge; wherein the linear angled portions are co-linear when the fold-over tabs are coplanar, and wherein the angled portions abut when the fold-over tabs are folded into contact with the back surface of the book cover.

4. The book cover corner guard of claim 3 wherein the fold-over tabs are smaller in area than the edge tab portions.

5. The book cover corner guard of claim 3 wherein the fold-over tabs are approximately equal in area to the edge tab portions.

6. The book cover corner guard of claim 3 wherein the central portion provides at least one curvilinear edge portion.

7. The book cover corner guard of claim 6 wherein the at least one curvilinear edge portion is outwardly curved.

8. The book cover corner guard of claim 6 wherein the at least one curvilinear edge portion is inwardly curved.

9. The book cover corner guard of claim 3 further comprising a beveled edge around a perimeter of the guard forming a down-sloping surface urging abutting pages to slip easily over the guard.

10. The book cover corner guard of claim 3 wherein the means for fold enablement comprises perforations and further includes, a dashed line overlaying the line of perforations.

11. The book cover corner guard of claim 3 wherein the means for fold enablement comprises a scoring along the fold line, and further includes a dashed line overlaying the fold line.

12. The book cover corner guard of claim 3 wherein the adhesive comprises a hot melt rubber adhesive.

13. The book cover corner guard of claim 3 wherein the adhesive comprises an emulsion acrylic adhesive.

14. The book cover corner guard of claim 3 wherein the corner guard is formed from a material taken from the group of materials including plastic, paper, cardboard, coated paper, sheet metal and leather.

15. The book cover corner guard of claim 1 wherein the means for folding enhancement is such as to be easily torn along the fold line so as to remove the fold-over tabs after the fold lines are aligned with the edges of the book cover corner, the fold-over tabs, being folded downwardly around the edges of the corner of the cover providing a means for easy alignment.

16. The book cover corner guard of claim 1 wherein the fold-over tabs are mutually joined so that the fold-over tabs are fixedly positioned at right angles to the body, thereby forming a preformed tab corner, so that with the guard body positioned in contact with the corner of the cover page, the tab corner is in overlapping adjacency with the corner of the book.

17. The book cover corner guard of claim 1 wherein the fold-over tabs each include a rib positioned along the delimiting edge such that the rib extends inwardly toward the pages of the book, thereby acting to engage the fold-over tab with the pages so that the cover is maintained in a closed position.

* * * * *